US005277511A

United States Patent [19]

Stockton

[11] Patent Number: 5,277,511

[45] Date of Patent: Jan. 11, 1994

[54] FLOWABLE MATERIAL SPREADER

[76] Inventor: Lonnie J. Stockton, 168 Sleepy Hollow Rd., Johnson City, Tenn. 37601

[21] Appl. No.: 766,345

[22] Filed: Sep. 27, 1991

[51] Int. Cl.[5] ..... B05C 17/00; B05C 17/12

[52] U.S. Cl. ..... 401/261; 118/255; 401/139; 401/265; 401/266; 425/87

[58] Field of Search ..... 401/137, 138, 139, 265, 401/266, 261, 263, 264, 285, 262, 5; 118/255; 425/87

[56] References Cited

U.S. PATENT DOCUMENTS

| | | | |
|---|---|---|---|
| 992,885 | 5/1911 | Lautenschlager | 401/264 |
| 1,141,103 | 6/1915 | Casler | 401/263 |
| 1,413,320 | 4/1922 | Charles | 401/261 X |
| 1,580,390 | 4/1926 | Trumbull | 401/285 X |
| 1,589,669 | 6/1926 | Van De Sandt | 401/5 |
| 2,014,149 | 9/1935 | Stafford | 401/264 |
| 2,624,901 | 1/1953 | Wiley | 401/264 |
| 2,804,767 | 9/1957 | Schoen | 401/261 X |
| 2,864,108 | 12/1958 | Johnson | 401/262 |
| 2,982,987 | 5/1961 | Knapp | 401/139 |
| 3,137,879 | 6/1964 | Dottson | 401/5 X |
| 3,289,241 | 12/1966 | Garrison et al. | 401/266 |
| 3,334,792 | 8/1967 | De Vries et al. | 401/266 X |
| 3,365,746 | 1/1968 | Gott | 401/266 X |
| 3,368,234 | 2/1968 | Edens, Jr. | 401/263 |
| 4,368,686 | 1/1983 | Dickson et al. | 401/266 X |
| 4,804,321 | 2/1989 | Riesgo | 401/5 X |

FOREIGN PATENT DOCUMENTS

| | | | |
|---|---|---|---|
| 1186784 | 2/1965 | Fed. Rep. of Germany | 401/266 |
| 2709771 | 9/1978 | Fed. Rep. of Germany | 401/5 |
| 129698 | 7/1919 | United Kingdom | 401/137 |
| 608521 | 9/1948 | United Kingdom | 401/265 |

*Primary Examiner*—Steven A. Bratlie

[57] ABSTRACT

An adhesive spreading or troweling device having a body provided with a multi-notched, elongated application edge, a plenum on the body adapted to receive and contain adhesive material under pressure, the plenum having a line of adhesive outlet aperture means below and adjacent to and substantially facing toward the application edge and extending substantially the full length thereof, the apertures being adapted to direct adhesive material onto a substrate in a controlled manner immediately ahead of the edge as the device is drawn along the substrate surface with the application edge in contact therewith.

5 Claims, 2 Drawing Sheets

FLOWABLE MATERIAL SPREADER

This invention relates generally to devices for applying and spreading adhesive, mortar, plaster or other cementitious material in the construction or finishing of building walls or other surfaces, or in floor covering operations wherein floor coverings are applied to sub flooring.

More particularly the invention relates to an adhesive applying device provided with a plenum into which the material to be spread is fed under pressure from a suitable source of supply, said device being adapted to direct the material by extrusion through aperture means in the plenum onto a receiving surface or substrate proximate to a notched spreader blade edge.

Spreading devices for various materials including mortar, plaster and the like are known and typically comprise a hollow head which is adapted to be connected to a pressurized source of supply for the material. The pressured material is typically forced from the source into the head for discharge onto the desired surface or substrate through a thickness gauging slot in the head.

With particular reference to the spreading of viscous adhesive material on floors, walls or other substrate surfaces for the securement thereto of coverings such as ceramic, vinyl or other tiles, or for wood, cellulosic board or the like panels, strips or plank, the adhesive must be layered down in stripes of somewhat precise and uniform dimensions and adhesive volume in order to ensure proper pressure contact of the adhesive with the substrate and covering and also to ensure uniform elevation of the covering with respect to the substrate.

Heretofore, edge notched hand spreaders or trowels have been employed for laying down these stripes, however, in using such devices it is necessary to place piles of adhesive on the substrate and manipulate the trowel, usually in a semi-circular motion, to spread out the adhesive into stripes. Such manipulation necessarily involves repeating the semi-circular motion in order to spread all of the adhesive which was initially placed in piles on the substrate, typically resulting in significant dimensional and volumetric non-uniformity of the stripes.

Objects, therefore, of the present invention are: to provide apparatus which eliminates the need for repetitive semi-circular adhesive spreading motion when forming and applying adhesive stripes to a substrate; to provide such apparatus which eliminates the need for piling adhesive material on the substratel to provide such apparatus which can be readily manipulated to form substantially parallel adhesive stripes; and to provide an adhesive feeding head for such apparatus wherein the head is easily removable from the apparatus for cleaning or replacement and disposal.

These and other objects hereinafter appearing have been attained in accordance with the present invention which is defined in accordance with preferred embodiments thereof as an adhesive spreading device comprising troweling means having body means provided with multi-notched, elongated application edge means, plenum means on said body means adapted to receive and contain adhesive material under pressure, said plenum means having a line of adhesive outlet aperture means positioned below the plane of said edge means and adjacent thereto and substantially facing theretoward and extending substantially the full length thereof, said aperture means being adapted to direct adhesive material onto a substrate in a controlled manner immediately ahead of said edge means as said device is drawn along the substrate surface with said edge means in contact therewith.

In certain preferred embodiments:

(a) the body means of the troweling means forms the floor of the plenum means;

(b) the plenum means is separate and removable from the body means and is affixable thereto by snap-fastener means;

(c) the body means forms a support structure to which a pressure operated adhesive cartridge can be affixed;

(d) the plenum means is provided with inlet means adapted for connection by suitable conduit means to a remote adhesive material reservoir; and (e) the adhesive outlet aperture means dimensions are selectable to accommodate variations in adhesive material composition and consistency or viscosity, and to accommodate the desired adhesive stripe dimensions and volume.

The invention will be further understood from the following description and drawings wherein certain dimensions are exaggerated for purposes of clarity and wherein.

Figure 1:
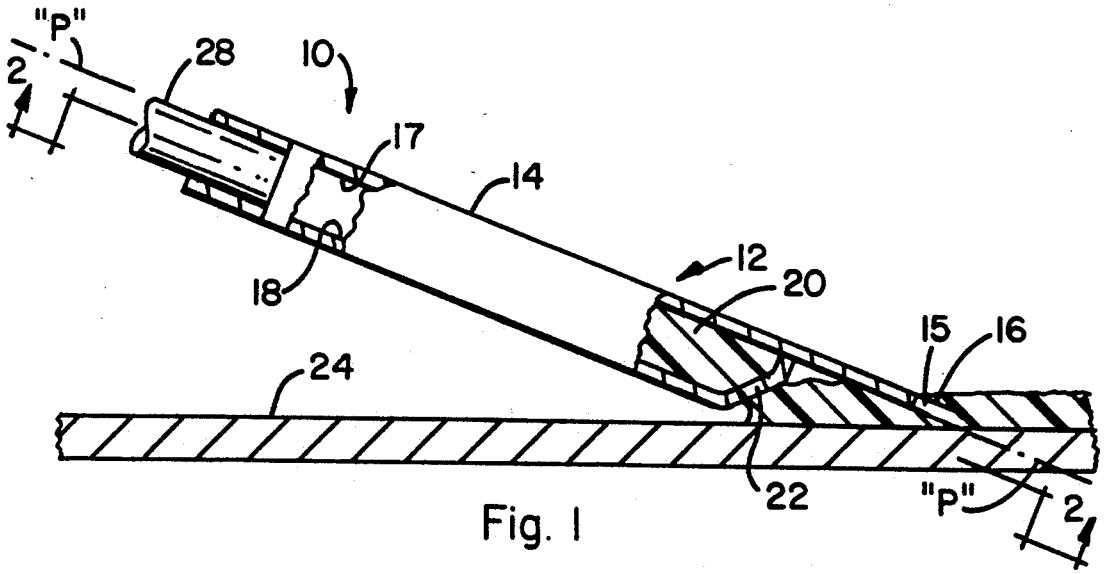
FIG. 1 is a side elevation of the present device, partially in section, with the application edge means thereof in contact with a substrate.
Figure 2:
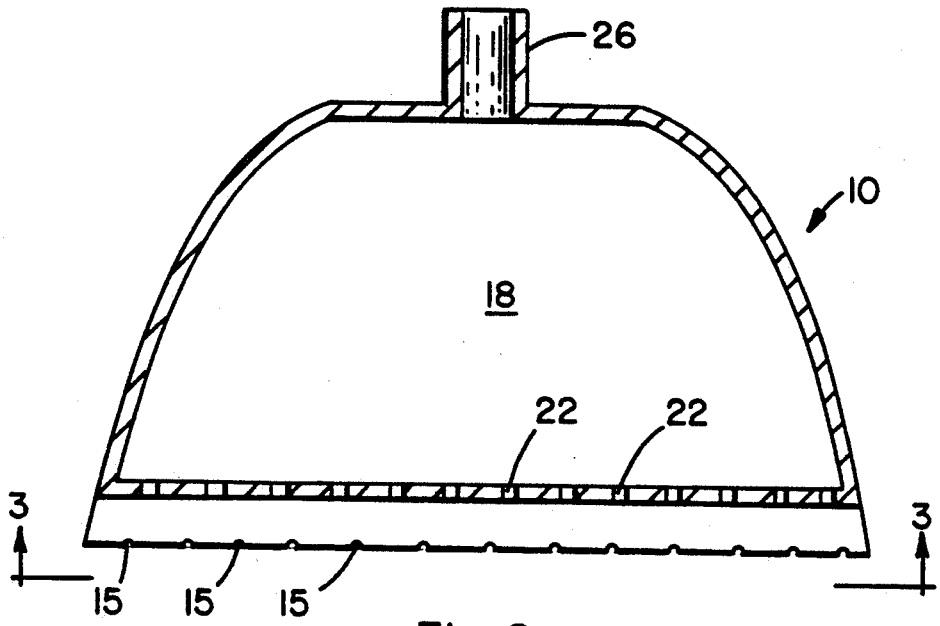
FIG. 2 is a cross-sectional view of the device taken along line 2—2 of FIG. 1 in the direction of the arrows.
Figure 3:
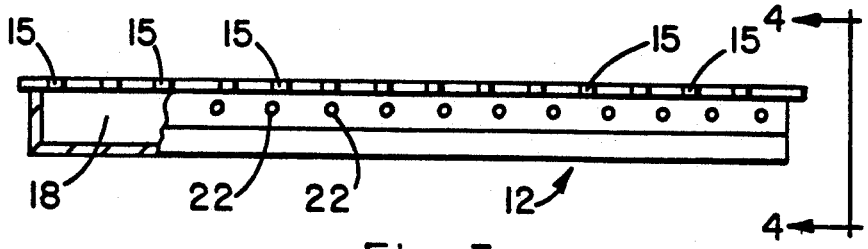
FIG. 3 is a right side up front end, elevational view, partially in section of the device taken in the direction of arrow 3 in FIG. 2.

Referring to the drawings and the claims hereof, the present adhesive spreading device generally designated 10 comprises troweling means 12 having body means 14 provided with multi-notched 15, elongated application edge means 16, plenum means 18 on said body means adapted to receive and contain adhesive material 20 under pressure, said plenum means having a line of adhesive outlet aperture means 22 positioned below the plane "P" of said edge means and adjacent thereto and substantially facing theretoward and extending substantially the full length thereof, said aperture means 22 being adapted to direct adhesive material 20 onto a substrate 24 in a controlled manner immediately ahead of said edge means as said device is drawn along the substrate surface with said edge means 16 in contact therewith.

The troweling means 12 may be of sheet material of metal or plastic formed as a unit or fabricated in known manner from sections thereof to form the body means 14 providing the plenum means 18 and the applicator edge means 16. The particular shape of the plenum means shown is not critical and variations thereof such as rectangular may be employed. The body means is provided with connecting neck 26 for frictional attachment to a material supply conduit 28 inserted therein such as the nozzle 23 of a cartridge 13 such as shown in U.S. Pat. No. 3,076,225, the disclosure of which is incorporated herein by reference. Alternatively, conduit 28 may be of substantial length, e.g., several feet, and connected to a remotely located pressurized material supply source or reservoir.

Figure 4:
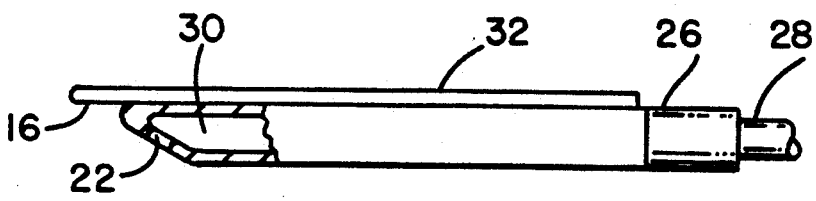
FIG. 4 is a partially sectioned side elevational view of the device taken in the direction of arrow 4 in FIG. 3 and showing a variation of individually constituted troweling plate means and plenum means.

Referring to FIG. 4, the body means 14 is comprised of a separate plenum means 30 equivalent to plenum means 18, and the application edge means 16 is provided on a separate plate means 32 equivalent in function with respect to providing edge means 16 to the top 17 of plenum means 18. With such an arrangement, the plenum means may be removably affixed to the plate 32 and edge means 16 by any suitable means such as snap-fasteners such that either the plate 32 or plenum 18 may be constructed to be disposable, or such that either may be used with variations of the other in order to modify the stripe pattern or volume, or to accommodate different materials. Such embodiments are further shown in FIGS. 5 and 6.

Figure 5:
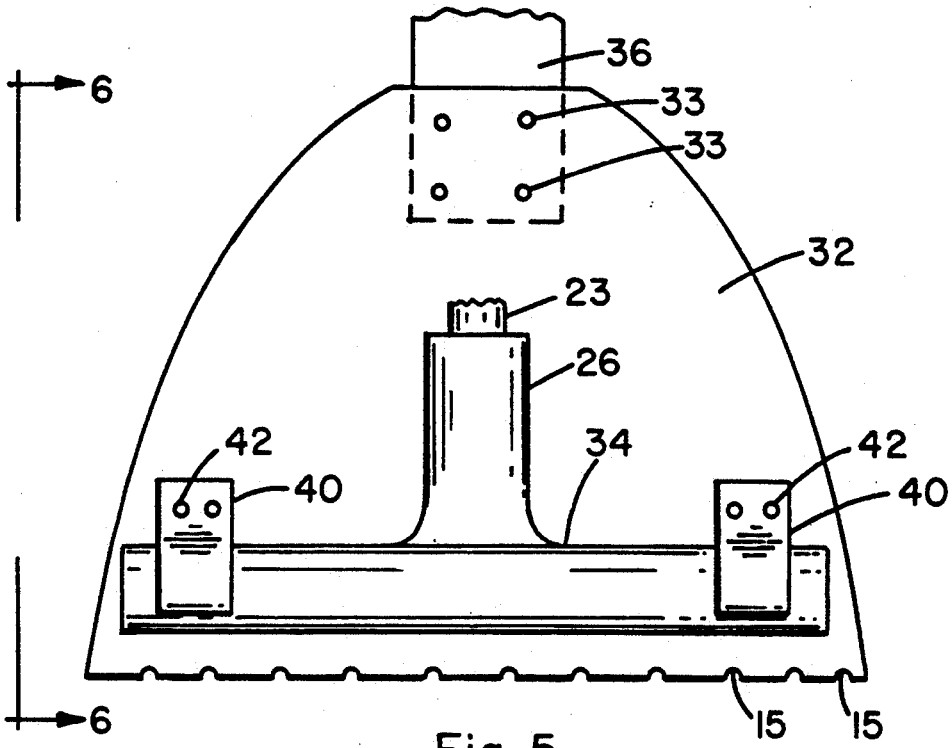
FIG. 5 is a bottom elevational view of a variation of the device showing readily removable plenum means.
Figure 6:
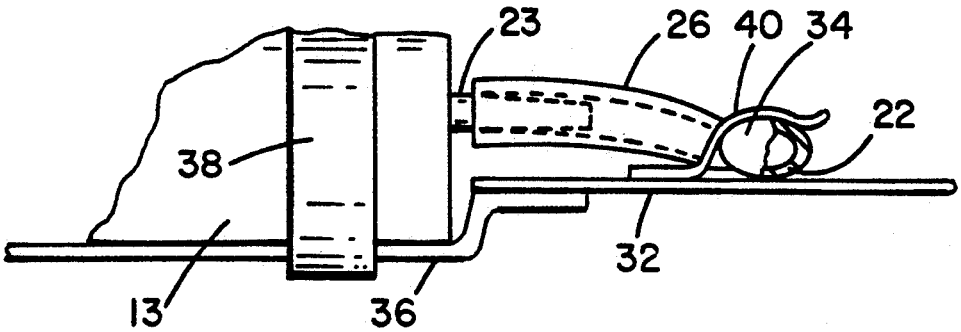
FIG. 6 is a partially sectioned side view elevational view of the device of FIG. 5 taken in the direction of arrow 6 therein, and showing a portion of a material supply.

Referring to FIGS. 5 and 6, the plenum is shown as an elongated tube 34 having a neck 26 for frictionally, sealingly receiving a supply conduit nozzle such as the aforesaid element 23 of cartridge 13 or the like. In this embodiment, the separable plate means 32 is spot welded or the like as at 33 to an extension such as 36 of any shape and size for conveniently supporting a material supply such as a cartridge 13 by clamps or snap-fastener means 38. The plenum 34 is likewise removably affixed to plate means 32, e.g., by snap-fastener means 40 spot welded or the equivalent as at 42 to plate 32. It is noted that for overhead type work, extension 36 may be elongated, e.g., several feet, and shaped as a broom handle or the like to provide adequate reach for the user.

The invention has been described in detail with particular reference to preferred embodiments thereof, but it will be understood that variations and modifications will be effected within the spirit and scope of the invention.

I claim:

1. An adhesive spreading device for laying a substantially corrugated pattern of highly viscous cementitious material on a substrate, comprising troweling means of generally sheet-like configured body means having a top side and an underside and provided with multi-notched, elongated application edge means defined by a plurality of substrate contacting surface means lying substantially in the plane of said underside, plenum means rigidly connected to said underside of said body means and adapted to receive and contain said material under pressure, said plenum means having a line of outlet aperture means for said material positioned below the plane of said underside and of said substrate contacting surface means and lying adjacent to said contacting surface means and substantially facing theretoward and extending substantially the full length thereof, said sheet-like body means adapted to be held at an angle to said substrate when in use and said aperture means being adapted to direct said material onto the substrate in a controlled manner immediately ahead of said edge means as said device is drawn along the substrate surface with said plurality of substrate contacting surface means in contact therewith.

2. The device of claim 1 wherein the body means of the troweling means forms the top of the plenum means.

3. The device of claim 1 wherein the plenum means is separate and removable from the body means, and cooperating snap-fastener means is provided on said plenum means and said body means for allowing said plenum means to be rapidly and rigidly affixed to and removed from said body means.

4. The device of claim 1 wherein the body means forms a support structure to which a pressure operated cartridge of said material can be affixed.

5. The device of claim 1 wherein the plenum means is provided with material inlet means adapted for rapid frictional connection by suitable conduit means to a remote material reservoir.

* * * * *